US007866010B2

(12) United States Patent
Schmidtke et al.

(10) Patent No.: US 7,866,010 B2
(45) Date of Patent: Jan. 11, 2011

(54) HOLDING DEVICE FOR CONNECTING A GAS MASK TO A PROTECTIVE HELMET

(75) Inventors: Klaus Schmidtke, Berlin (DE); Tanguy Seve, Villeurbanne (FR); Phillippe Fitoussi, Eragny sur Oise (FR); Wilfried Hoffmann, Berlin (DE)

(73) Assignee: MSA Auer GmbH, Berlin (DE)

( * ) Notice: Subject to any disclaimer, the term of this patent is extended or adjusted under 35 U.S.C. 154(b) by 1100 days.

(21) Appl. No.: 10/550,517

(22) PCT Filed: Feb. 19, 2004

(86) PCT No.: PCT/DE2004/000332

§ 371 (c)(1),
(2), (4) Date: Oct. 2, 2006

(87) PCT Pub. No.: WO2004/084997

PCT Pub. Date: Oct. 7, 2004

(65) Prior Publication Data

US 2007/0157439 A1 Jul. 12, 2007

(30) Foreign Application Priority Data

Mar. 24, 2003 (DE) ..... 103 14 136

(51) Int. Cl.
*A44B 99/00* (2010.01)
*A62B 18/08* (2006.01)

(52) U.S. Cl. ..... 24/300; 24/301; 24/302; 24/265 H; 2/422

(58) Field of Classification Search ..... 24/265 H, 24/300–302; 2/422, 3.6, 426
See application file for complete search history.

(56) References Cited

U.S. PATENT DOCUMENTS

| | | | | |
|---|---|---|---|---|
| 4,817,596 | A | 4/1989 | Gallet | |
| 5,598,956 | A * | 2/1997 | Schenberg | 223/1 |
| 6,389,606 | B1 | 5/2002 | Galet | |
| 6,442,767 | B1 * | 9/2002 | Meckes et al. | 2/424 |

FOREIGN PATENT DOCUMENTS

| | | |
|---|---|---|
| FR | 2 668 374 A | 4/1992 |
| FR | 2 707 141 A | 1/1995 |

OTHER PUBLICATIONS

International Search Report issued in International Application No. PCT/DE2004/000332 on Aug. 11, 2004.
International Preliminary Examination Report mailed Mar. 2, 2006 in corresponding International Application PCT/DE2004/000332.

* cited by examiner

*Primary Examiner*—Robert J Sandy
(74) *Attorney, Agent, or Firm*—Davidson Berquist Jackson & Gowdey, LLP

(57) ABSTRACT

A holding device for a breathing mask that is fastened to a protective helmet when in use includes a fastening hook connected to a flexible, length-adjustable tightening strap that is hooked into a receptacle on the protective helmet. Stop elements that are both frictionally engaged and in positive contact prevent the accidental release of the fastening hook together with the flexibility of the tightening strap that at the same time ensures an individually adjustable fit of the mask while sliding elements arranged at an offset to the stop elements ensure automatic optimum orientation of the tightening straps. The tightening strap and the fastening hook are coupled using a retainer piece molded to the tightening strap that is held in positive contact in the recess of a grip end connected with the fastening hook.

5 Claims, 2 Drawing Sheets

HOLDING DEVICE FOR CONNECTING A GAS MASK TO A PROTECTIVE HELMET

This invention relates to a holding device for a breathing mask to attach the mask to a protective helmet comprising fastening hooks on both sides of the breathing mask that can be hooked into hook receptacles formed on the outside of the helmet.

Breathing masks that are not directly held by the wearer's head but are fastened to a protective helmet using a specific holding device and tightened to the mask wearer's face are known. They enable the wearer during an operation to put the breathing mask on without having to take off the protective helmet. In a known combination of a breathing mask and a protective helmet, a holding device is attached to the lateral edges of the breathing mask that comprises a fastening rod hinged to the breathing mask with a fastening hook telescopically attached to its free end by means of a tension spring while the protective helmet has a receptacle for the hook on its opposite sides into which the respective fastening hook is hooked against the action of the spring to keep the mask tightened to the wearer's face.

Putting the breathing mask on with this relatively complicated holding device can be difficult as the fastening hooks that are subject to spring action and attached to a rigid extension rod can simply not be handled in difficult working conditions. The breathing mask can either be too tight or too loose depending on the wearer's head size as the spring force cannot be adjusted, resulting in reduced wearing comfort, reduced impermeability or easy slipping of the breathing mask. While there is an indirect way of adjusting the spring force by moving the receptacles for the hook but this means that the protective helmets cannot be exchanged among wearers with different head shapes. It is the object of the invention to provide a holding device for fastening a breathing mask to a protective helmet that is of simple design and can be handled with ease while being convenient to wear and put on and ensuring safe breathing protection.

This problem is solved according to the present invention.

An important characteristic of the invention is that the fastening hooks are attached to a flexible tightening strap that can be adjusted in length and that the fastening hooks can easily be inserted in their receptacles. The secure fit of the mask on the wearer's face can be adjusted individually depending on the shape of the wearer's head. In combination with the slack tightening strap, stop elements are provided in the area of the fastening hook that are in frictional or positive contact with the helmet or its hook receptacle so that the fastening hooks won't even become unhooked from the receptacles if an external force acts on the breathing mask. According to one other important characteristic of the invention combined with the characteristics mentioned above, the frictional or positive stop elements are associated with offset sliding elements that ensure automatic positioning of the fastening hooks and proper orientation of the tightening straps for an optimum fit of the mask when the tightening straps are tightened. Under these conditions, a holding device with fastening hooks ensures convenient putting on and wearing comfort as well as a secure fit of a breathing mask to be connected to a protective helmet.

In a further improvement of the invention, the fastening hook is formed as a grip end with ergonomically designed grip elements to make handling the holding device easier even if the wearer is wearing gloves.

The tightening strap is connected with the fastening hook by means of a holding piece molded onto the tightening strap and positively held in a recess formed in the grip end. Stop elements made of the same rubber-type elastic material as the holding piece are molded to the free surface of the holding piece while sliding elements are formed on the rim of the recess of the grip end which consists of a firm material with good sliding properties.

The holding device is of a simple and cost-efficient design.

An embodiment of the invention is explained in greater detail below with reference to the figures.

Figure 1:
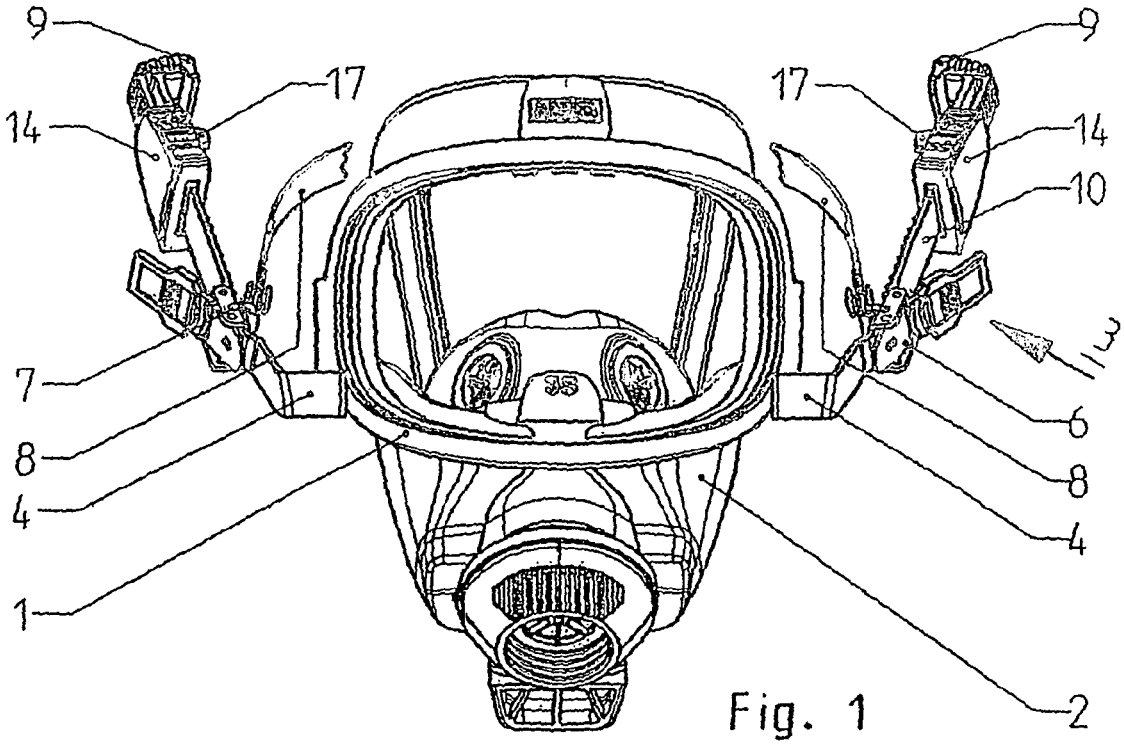
FIG. 1 shows a front view of a breathing mask with holding devices attached to the sides of the mask body that can be used to fasten the breathing mask to a protective helmet.
Figure 2:
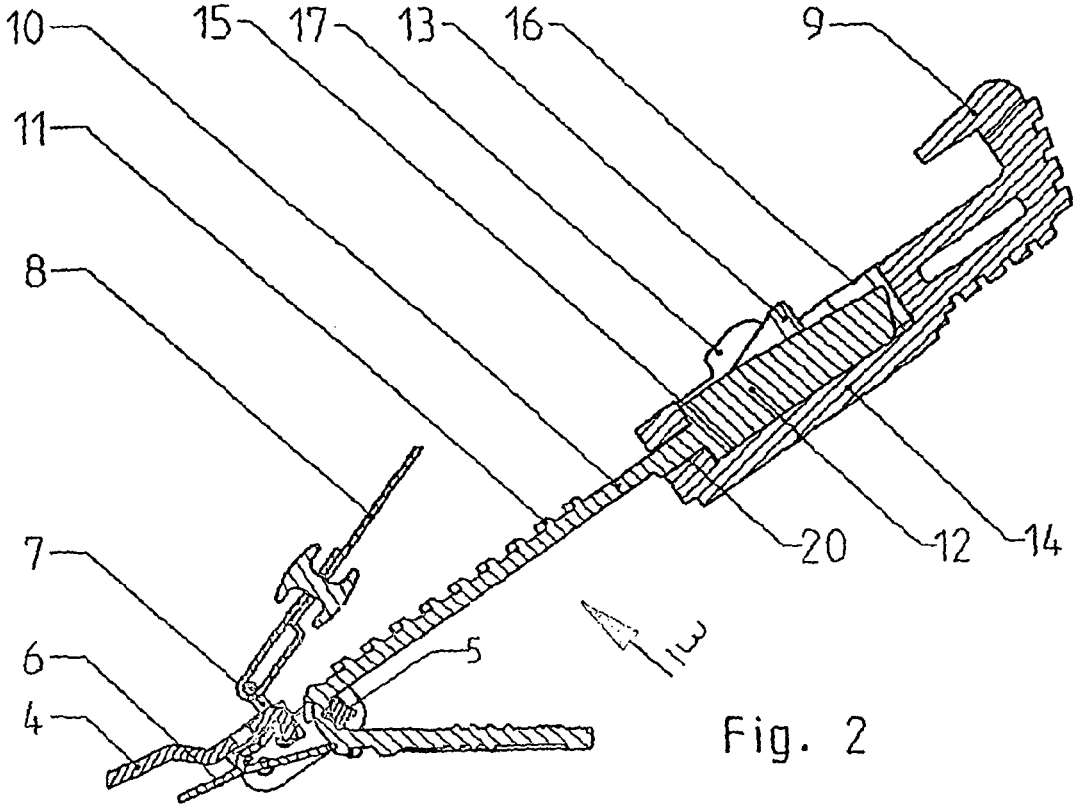
FIG. 2 shows a sectional view of the holding device, and und
Figure 3:
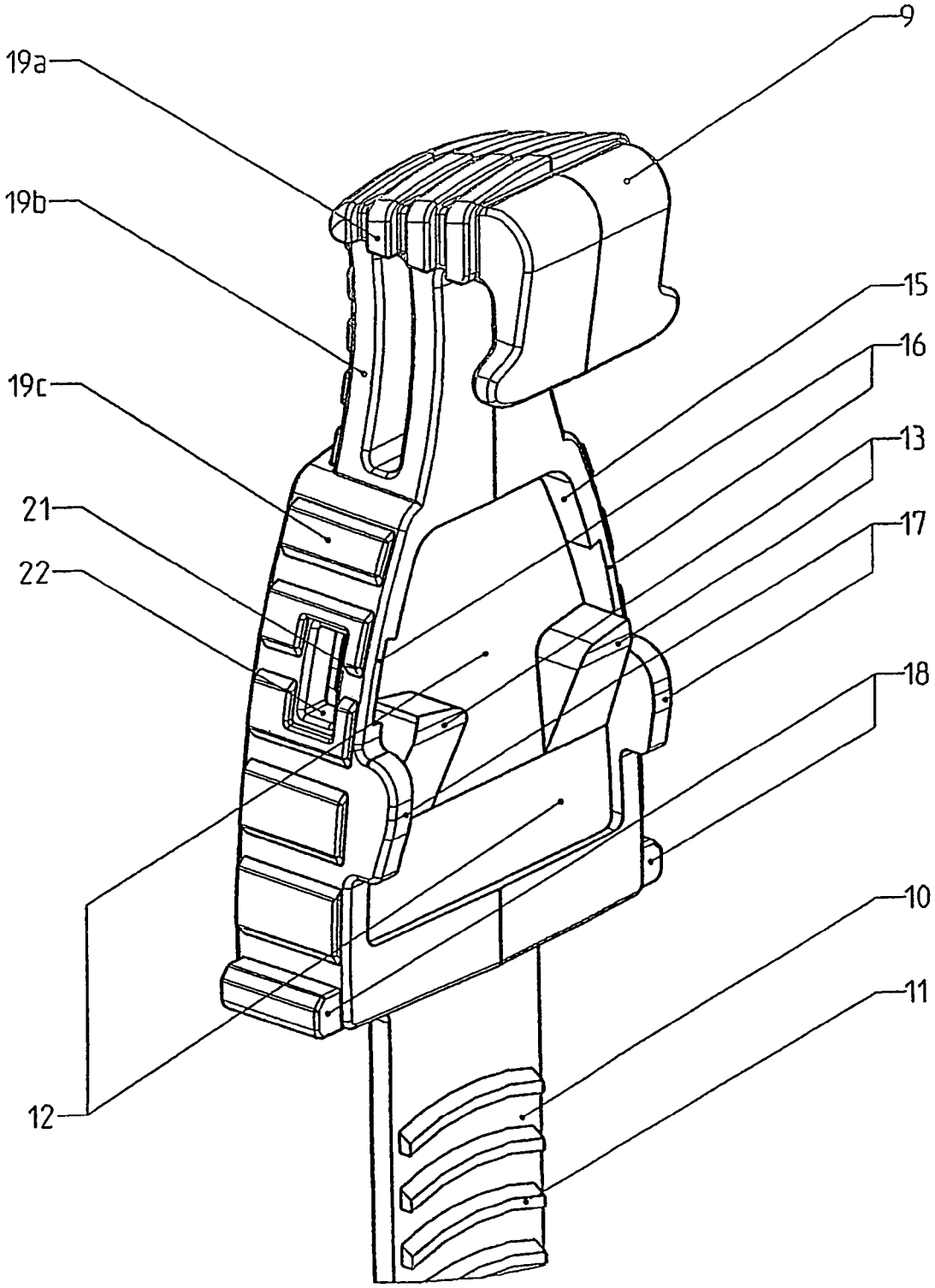
FIG. 3 shows a detailed perspective view of the holding device with a tightening strap terminal integrated in the grip end of a fastening hook.

As FIG. 1 shows, a holding device 3 is attached to the visor edge 1 of a breathing mask 2 using an arm 4. The interlocking device for a tightening strap 10 comprising a jamming roller 5 with a profile and a lock button 6 that can be rotated under spring action is provided on the free end of the arm 4. The end of the arm also comprises a retaining ring 7 for fastening a neck strap 8. The neck strap 8 can be used to wear the breathing mask 2 around the mask wearer's neck when it is not in use so that it is available for use at all times. The holding device 3 further includes the tightening strap 10 that stretches in transversal direction and comprises locking webs 11 at spacing; it is conducted between the jamming roller 5 and the lock button 6 and can be fixed at the desired locking web location for a tight fit of the mask to the wearer's face. A holding piece 12 with stop elements 13 on its surface is molded in one piece to the end of the tightening strap 10 that is distant from the interlocking device. The tightening strap 10, the retainer piece 12, and the stop elements 13 consist of a rubber-type elastic material. A reinforcement is incorporated in the tightening strap 10 so that the tightening strap 10 is still flexible but basically cannot stretch in longitudinal direction.

The holding device further includes a fastening hook 9 made of a rigid material (duroplastic) and linked to the tightening strap 10. This hook can be hooked into a receptacle (not shown) on the outside of a protective helmet (not shown) to connect the breathing mask 2 and the protective helmet. The hook receptacle is wider than the fastening hook 9 so that it can be inserted in the receptacle with ease.

The fastening hook 9 and the tightening strap 10 are interconnected using a grip end 14 that is attached to the fastening hook 9; a recess 15 is molded into this grip end 14 in which the retainer piece 12 molded onto the tightening strap 10 is held in positive contact by ribs 21 molded onto the retainer piece 12 that engage with the locking openings 22 in the opposite lateral edges 16 of the grip end 14, as well as by a slot 20 provided in the rear edge of the grip end through which the tightening strap 10 is conducted. The retainer piece 12 that is positively fitted into the recess 15 is dimensioned in such a way that it does not protrude over the lateral edges 16 of the recess 15 formed in the grip end or ends below the upper edge of said recess. However the stop elements 13 protrude beyond the upper edges of the lateral edges 16.

Slide rails 17 are formed on the lateral edges 16 of the recess 15 on the grip end 14 that slightly stretch beyond the stop elements 13 and are placed at a slight offset to these elements. To make unhooking and hooking in the fastening hook 9 easier, even if the user is wearing gloves, grip elements 18 are formed on the end of the grip end 14 that faces the tightening strap 10 and grip elements 19*a* , 19*b* , 19*c* are formed in the area of the fastening hook 9.

When the wearer puts on the breathing mask 2, the lower ends of the tightening straps 10 are in the area of the jamming roller 5 and the lock button 6, leaving sufficient room for hooking the fastening hooks 9 into the hook receptacles on the protective helmet (not shown). Subsequently, the wearer tightens the tightening straps 10 between lock button and jamming roller depending on his or her head shape and size so that the edge of the mask fits sufficiently tight and comfortably to the wearer's face. When the wearer does this, the fastening hook 9 automatically slides along the sliding elements 17 into the preset position in the hook receptacle. The tightening strap 10 is orientated between jamming roller/lock button 5, 6 so that the tensile strain is greater on the upper edge than on the lower edge of the tightening strap 10. This position or loading of the tightening strap 10 proved advantageous for a comfortable and gastight fit of the breathing mask. If a frontal force acts on the breathing mask, for example when the wearer hits an obstacle in narrow spaces, the fastening hook 9 cannot become unhooked from the hook receptacle in the protective helmet due to the flexibility of the tightening strap 10 and the rubber-type elastic stop elements 13 that protrude from the retainer piece 12 of the tightening strap 10. If an impact on the breathing mask does apply a force to the fastening hook 9 via the flexible tightening strap 10, its movement beyond the stop elements 13 is prevented by positive contact with an edge of the hook receptacle and by frictional engagement of the rubber-type elastic material.

LIST OF REFERENCE SYMBOLS

1 Visor edge
2 Breathing mask
3 Holding device
4 Arm
5 Jamming roller
6 Lock button
7 Retainer ring
8 Neck strap
9 Fastening hook
10 Tightening strap
11 Locking webs of 10
12 Retainer piece of 10
13 Stop elements of 12
14 Grip end
15 Recess of 14
16 Lateral edge of 15
17 Sliding elements of 15
18 Grip element on 14
19(*a,b,c*) Grip element on 9
20 Slot of 14
21 Rib of 12
22 Locking opening

The invention claimed is:

1. A holding device for a breathing mask for connecting the mask to a protective helmet with fastening hooks on both sides of the breathing mask that can be hooked into hook receptacles form on the outside of the protective helmet, wherein the fastening hooks are connected to the breathing mask through a length-adjustable, slack tightening strap, including stop elements formed in the area of the fastening hook to hold the fastening hook in hooked-in position, and sliding elements stretch beyond the stop elements and are positioned at an offset, and a grip end that includes a recess that is molded to the fastening hook and a retainer piece that is molded to the tightening strap, said retainer piece positively fits into the recess while the stop elements are molded to a free surface of the retainer piece and the sliding elements are molded to lateral edges of the recess formed in the grip end.

2. The holding device according to claim 1, wherein the fastening hook including the grip end and sliding elements consist of a firm material with a low friction coefficient and in that the retainer piece with the stop elements molded onto it consists of a material with a high friction coefficient.

3. The holding device according to claim 1, wherein ribs that are fixed in locking openings formed in the grip end are molded onto the retainer piece for positive contact, and in that the tightening strap connected with the retainer piece is conducted through a slot in the grip end.

4. The holding device according to claim 1, wherein a protruding first grip element is formed on the grip end.

5. The holding device according to claim 1, wherein an ergonomically molded second and grip element is formed on the fastening hook.

* * * * *